US006483239B1

(12) United States Patent
Kabuki et al.

(10) Patent No.: US 6,483,239 B1
(45) Date of Patent: Nov. 19, 2002

(54) LIGHT SOURCE DEVICE

(75) Inventors: Kiyoyuki Kabuki, Ibo-gun (JP); Yoichiro Higashimoto, Himeji (JP); Toshiyuki Suga, Himeji (JP); Masashi Nakayama, Takasago (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 101 days.

(21) Appl. No.: 09/762,301

(22) PCT Filed: Jun. 5, 2000

(86) PCT No.: PCT/JP00/03636

§ 371 (c)(1),
(2), (4) Date: Feb. 8, 2001

(87) PCT Pub. No.: WO00/75960

PCT Pub. Date: Dec. 14, 2000

(30) Foreign Application Priority Data

Jun. 8, 1999 (JP) ..... 11-161118

(51) Int. Cl.[7] ..... H01J 17/04
(52) U.S. Cl. ..... 313/620; 313/113
(58) Field of Search ..... 313/620, 113, 313/115

(56) References Cited

U.S. PATENT DOCUMENTS 4,305,099 A 12/1981 True et al.

FOREIGN PATENT DOCUMENTS

| | | |
|---|---|---|
| JP | 5-3019 A | 1/1993 |
| JP | 5-41197 A | 2/1993 |
| JP | 7-37553 A | 2/1995 |
| JP | 8-7840 A | 1/1996 |
| JP | 11-204085 A | 7/1999 |

*Primary Examiner*—Vip Patel
(74) *Attorney, Agent, or Firm*—Nixon Peabody LLP; David S. Safran

(57) ABSTRACT

A light source device including a short arc discharge lamp having a pair of opposed electrodes within a light emitting bulb of a discharge container, and a concave reflector having an optical axis arranged to coincide with a direction of an arc produced by the electrodes when the discharge lamp is activated. The electrodes are spaced from each other at a distance of 4.0 mm or less and the light emitting bulb has an inner surface and an outer surface which, at least in a specific portion, have substantially spherical surfaces with a center of curvature which is at a center of the arc. The specific portion is located in front of a critical line that passes through the light emitting bulb, the specific portion being an angle having an apex at the center of the arc. The concave reflector has an optical axis that is at least 3 sr in front of a plane which passes through the center of the arc and perpendicular to the optical axis of the concave reflector.

6 Claims, 5 Drawing Sheets

LIGHT SOURCE DEVICE

TECHNICAL FIELD

This invention relates to a light source device, and more particularly a light source that is used as a light source for a projector or a light source for a fiber lighting system.

BACKGROUND ART

In general, in the case of a light source device used as a light source for a projector or a light source for a fiber lighting system, it is necessary to achieve that light radiated from a light source lamp is collected efficiently and radiated against an area to be irradiated. Normally, such a light source device as described above is constituted by a short arc discharge lamp and a concave reflector for collecting light radiated from the discharge lamp.

In recent years, it has been required to provide a small-size light source device in which the rate of utilization of light radiated from the short arc discharge lamp is high.

FIG. 7 is an illustrative view showing one example of a configuration of this kind of light source device in the prior art. This light source device 50 is constituted such that a short arc discharge lamp 51 is assembled in a concave reflector 58.

A discharge container of the short arc discharge lamp 51 is constituted by a light emitting bulb 52 and sealing parts 53 extending at both ends of the light emitting bulb 52, wherein a cathode 54 and an anode 55 are arranged opposite to each other within the light-emitting bulb 52.

The light-emitting bulb 51 of the discharge container is formed to have a rugby-ball type spinning barrel shape, for example, having a large inner surface area in view of its purpose to reduce the load on the bulb wall and prevent the phenomenon of devitrification of the light-emitting bulb 51.

In turn, the concave reflector 58, for example, is a mirror having an elliptical surface with an optical axis L, the discharge lamp 51 is arranged such that it coincides with the optical axis L in its arc discharge direction, and a bright spot position A of the arc formed between the cathode 54 and the anode 55 (hereinafter called "a center of the arc") is coincident with a first focal point of the concave reflector 58.

In the case of the light source device 50, light radiated toward a rear region positioned in a rear part (the left side in the figure) of a virtual straight line N connecting any point M on the front outer edge of the concave reflector 58 with the center A of arc is collected by the concave reflector 58 and radiated against the area to be irradiated.

However, light radiated toward the front region positioned in front of the virtual straight line N, for example, almost all light I3 of the radiated light I11 radiated from the center A of the arc in one possible forward direction P, passes through the bulb wall of the light emitting bulb 52, and the light cannot be collected by the concave reflector 58, with the result that the light cannot be effectively utilized.

In turn, the part I12 of the light of the radiated light I11 is reflected by an inner surface 52*a* of the bulb wall of the light emitting bulb 52, and the part of light I22 of light I21 which penetrated an inner surface and passed through the inner surface 52*a* of the bulb wall is reflected by the outer surface 52*b* of the bulb wall. In this case, the rate of light reflected by both surfaces reaches 8% of the incident light.

However, since the directions of the inner surface reflecting light I12 and the outer surface reflecting light I22 are not appropriate, or the light is shut off by the electrodes, or a part of it is absorbed by the electrodes, both types of light cannot be utilized effectively.

In order to increase the rate of utilization of light radiated from the short arc discharge lamp, the specification of U.S. Pat. No. 4,305,099, for example, provides a light source device having a constitution in which a ring-like auxiliary concave reflector is arranged at a forward position of the concave reflector in such a way that the first focal point is coincident with a first focal point of the concave reflector.

However, actually, it is quite hard to arrange the auxiliary concave reflector at a proper position with high accuracy so that at last there occurs the problem that the characteristic of a spot light source of the short arc type discharge lamp is lost.

As described above, in the case of the light source device utilizing a prior art short arc discharge lamp, actually, the light reflected at the light-emitting bulb cannot be utilized effectively and a high rate of utilization of light cannot be realized.

An object resolved by the present invention is to provide a small-size light source device having a simple construction and showing a high rate of utilization of light radiated from the short arc discharge lamp.

DISCLOSURE OF INVENTION

In order to solve the problem described above, the light source device of the present invention is comprised of a short arc discharge lamp in which a pair of electrodes are arranged opposite within a light emitting bulb of a discharge container, and a concave reflector is arranged in such a way that the arc direction of the discharge lamp is coincident with the optical axis, wherein a distance between the electrodes in the short arc discharge lamp is 4.0 mm or less, the light emitting bulb of the short arc discharge lamp, at least in a specific portion of its inner surface and its outer surface, has a spherical surface surrounding a center (A) of the arc, wherein the specific portion is in a front region in front of a critical straight line (D) and is defined by a solid angle of at least 3 sr or more, with the center (A) of the arc being an apex and the optical axis (L) of the concave reflector being a central axis, and wherein the critical straight line (D) is a straight line connecting the center (A) of the arc with a point (Y) corresponding to a cross point where an extended line of a virtual straight line (N) connecting any point (M) on the front outer edge of the concave reflector with the center (A) of the arc intersects the outer surface of the bulb wall of the said light emitting bulb.

Further, in the case of the aforesaid light source device, it is preferable that the outer surface at least in the specific portion of the light emitting bulb of the short arc discharge lamp is provided with a reflective film.

Further, in the case of the aforesaid light source device, the short arc discharge lamp can be made such that a cathode and an anode are arranged opposite to each other within a light emitting bulb in a discharge container, the cathode is arranged within the concave reflector while being positioned at a forward position, the light emitting bulb has a form elongated in a direction of the optical axis (L) within a rearward region where it is positioned at a more rear part than the critical straight line (D).

In accordance with the aforesaid configuration, a part of the light radiated toward the front region can be utilized advantageously, resulting in that a high rate of utilization of light can be realized. That is, the inner surface and the outer surface of at least the specific portion in the front region of the light emitting bulb of the short arc type discharge lamp are spherical surfaces, the center of the spherical surface is coincident with the center of the arc, whereby the light reflected by these surfaces is returned back to the arc region, resulting in that the reflected light can be utilized effectively by the concave reflector.

In the case that a reflective film is formed on the outer surface in at least the specific portion in the front region of the light emitting bulb of the short arc type discharge lamp, the light which must pass through the outer surface of the bulb wall of the light emitting bulb is also reflected and returned back to the arc region, resulting in that almost all of the light radiated toward the front region can be utilized effectively by the concave reflector and at the same time the constitution of the light source device can be made simple and small in size.

BEST MODE FOR CARRYING OUT THE INVENTION

Figure 1:
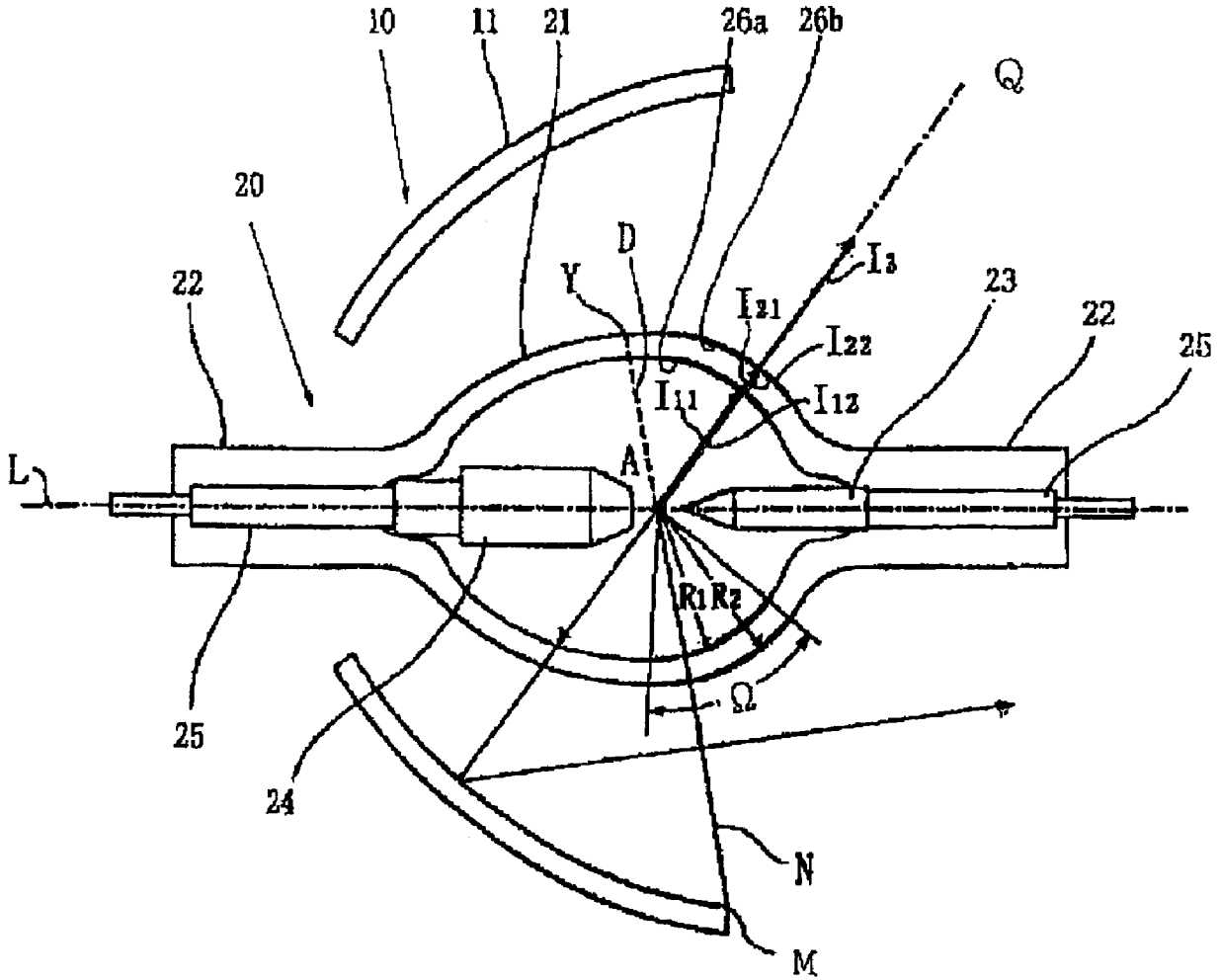
FIG. 1 is a longitudinal illustrative sectional view showing a constitution of one example of the light source device of the present invention.

Referring now to the drawings, the light source device of the present invention will be described in detail as follows. FIG. 1 is a longitudinal illustrative sectional view showing a constitution of one example of the light source device of the present invention. This light source device 10 is comprised of a concave reflector 11 having a reflection surface with an elliptical surface area and a short arc discharge lamp 20.

The concave reflector 11 has an optical axis L extending in a forward or rearward direction (a forward or rearward direction as shown in the figure), and its inner surface is provided with a dielectric multi-layer reflective film (not shown) in which tantalum oxide ($Ta_2O_5$) and silica ($SiO_2$), for example, are laminated.

The short arc discharge lamp 20 is comprised of a discharge container made of quartz glass, for example, and both a cathode 23 and an anode 24 are arranged in the discharge container, the discharge container is constituted by a light emitting bulb 21 and rod-like sealing parts 22 correspondingly arranged to extend from both ends of the light emitting bulb 21 in an outward direction.

Within the light emitting bulb 21 the cathode 23 and the anode 24 are arranged opposite from each other in a state in which a distance between the electrodes is 4.0 mm or less, wherein electrode rods 25 having either the cathode 23 or the anode 24 fixed at its extreme ends extend through the sealing parts 22, their rear ends arranged to project out of both ends of the sealing parts 22, the sealing parts 22 and the electrode rods 25 are melted and adhered to each other to form an air-tight seal section.

Further, the short arc discharge lamp 20 is assembled in an inside part of the concave reflector 11 in a state in which the cathode 23 is positioned in front of the anode 24 (the right side in the figure), its arc direction coincident with the optical axis L of the concave reflector 11 and the center A of the arc coincident with a first focal point of the concave reflector 11. In the case of a DC lighting short-arc discharge lamp, it can be considered that the position spaced apart by 0.3 d from the extreme end of the cathode is assumed to be the center A of the arc when the distance between the electrodes is defined as "d", and in turn in the case of an AC lighting short arc discharge lamp, it can be considered that the position near the center of the distance between the electrodes is assumed to be the center A of the arc.

The light emitting bulb 21 of the short arc discharge lamp 20 is assumed to have the following form.

Both the inner surface and the outer surface of the bulb wall of the light emitting bulb 21 are used with a spherical surface 26*a* with a radius of R1 and a spherical surface 26*b* with a radius of R2 where the center A of the arc is a center of each of the surfaces within the following specific portion.

This specific portion is a region which, when a virtual straight line N connecting any point M on a front outer edge of the concave reflector 11 with the center A of arc is defined and a point where an extended line extending through the center A of the arc intersects the outer surface of the bulb wall of the light emitting bulb 21 is assumed to be Y, the center A of the arc being applied as an apex, is located in a front region where it is positioned in front of a critical straight line D connecting the point Y with the center A of the arc and a solid angle with the center A of the arc being applied as an apex and with the optical axis L of the concave reflector being applied as a central axis is at least 3 sr or more.

The "front region", in other words, is a region positioned in front of a accumulation of critical straight lines D (normally, this will be a conical surface formed when the critical straight lines D are rotated around the optical axis L).

The specific portion in the light source device 10 in the example shown in the figure practically is a region where the solid angle with the center A of the arc being applied as an apex and with the optical axis L of the concave reflector is at least 3 sr or more in front of a plane passing through the center A of the arc and perpendicular to the optical axis L.

In addition, the light emitting bulb 21 has an elongated form extending in a direction of the optical axis L, for example, and a spinning barrel at the rear region positioned at a rear part of the critical straight lines D.

Figure 2:
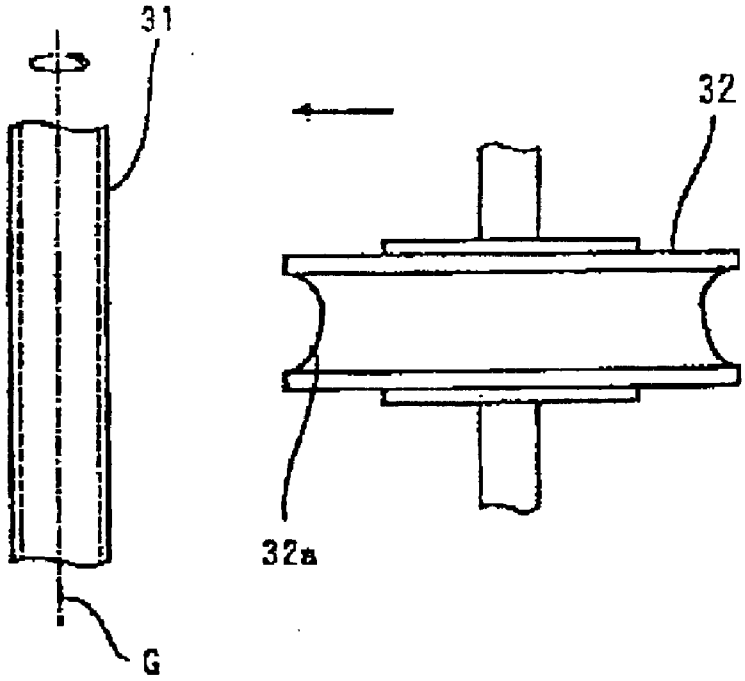
FIG. 2 is an illustrative view showing one example of means for manufacturing a discharge container material constituting a short arc type discharge lamp.
Figure 3:
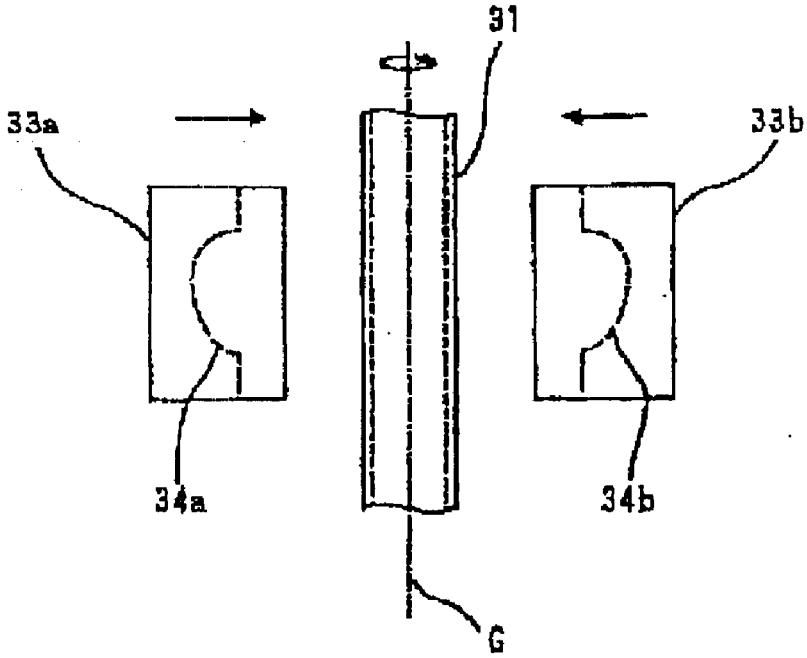
FIG. 3 is an illustrative view showing another example of means for manufacturing a discharge container material constituting a short arc type discharge lamp.

As a means for manufacturing the discharge container material for the aforesaid short arc discharge lamp 20, for example, it is possible to utilize the following (1), (2) and the like:

(1) means that, as shown in FIG. 2, a quartz straight line bulb 31 is heated with a burner while being rotated around the bulb axis G by a glass lathe and kept at a decreased viscosity, a disc-like roller 32 provided with a die surface 32a formed as a groove of arcuate shape in an axial section is rotated around an axis parallel to the bulb axis G of the quartz bulb 31 and is moved in a direction indicated by an arrow and contacted with the quartz bulb, an inner side of the quartz bulb 31 is pressurized with nitrogen gas in this state to cause the light emitting bulb portion to be bulged out and shaped; and (2) means that, as shown in FIG. 3, a quartz straight line bulb 31 is heated with a burner while being rotated around the bulb axis G by a glass lathe and kept at a decreased viscosity, split-type dies 33*a,* 33*b* provided with dies 34*a,* 34*b* having concave spherical surfaces are moved in a direction indicated by the arrows to hold the bulb, an inner side of the quartz bulb 31 is pressurized with nitrogen gas in this state to cause the light emitting bulb portion to be bulged out and shaped.

In addition, as means for checking the shape of the light emitting bulb portion made of the material of the manufactured discharge container, the inner surface of the bulb wall of the light emitting bulb portion can be checked, for example, by measuring with a projector or a CCD camera an immersed state of the entire discharge container material in glycerin. Further, the outer surface of the bulb wall of the light emitting bulb portion can be checked through measurement by a three-dimensional measuring instrument, for example.

Confirmation of the shape at the light emitting bulb by such means as described above ensures that the bulb has the desired spherical inner surface and outer surface in the aforesaid specific portion can be advantageously selected and chosen.

In the aforesaid light source device 10, the part of light I12 of the radiated light I11 radiated from the center A of the arc of the lit short arc discharge lamp in an optional direction Q in the front region, for example, is radiated by the inner surface 26*a* of the bulb wall of the light emitting bulb 21. The inner surface reflected light I12 is returned back to the arc region to increase the brightness of the arc or passes through the arc and is collected by the concave reflector 11.

In addition, the part of light I22 of the inner surface passing light I21 permeating through the inner surface 26*a* of the bulb wall of the light emitting bulb 21 is reflected by the outer surface 26*b* of the bulb wall of the light emitting bulb 21. The outer surface reflected light I22 is also returned back toward the arc region and similarly collected by the concave reflector 11.

In accordance with the aforesaid light source device, it is possible to advantageously utilize a part of light radiated to the front region, resulting in that it is possible to realize a high rate of utilization of light.

That is, the inner surface and the outer surface of the part within the specific portion in the front region of the light emitting bulb 21 of the short arc discharge lamp 20 are spherical surfaces and their center is coincident with the center A of the arc, whereby the light reflected by these surfaces is advantageously returned back to the arc region so that the reflected light can be effectively utilized by the concave reflector 11 with the result that the rate of utilization of light can be improved.

In addition, the region in which the inner surface and the outer surface in the front region in the light emitting bulb 21 have spherical surfaces is a region in which a solid angle with a center A of the arc being applied as an apex and with the optical axis L of the concave reflector 11 being applied as a central axis is 3 sr or more, so that in practice it is possible to advantageously increase the rate of utilization of light by 5%.

Further, since the already described specific portion in the front region is a region which is radiated with light having a relatively high radiation intensity, effective utilization of this light enables the rate of utilization of light to be increased.

When, in the case of the aforesaid short arc type discharge lamp, the distance between the electrodes is 4.0 mm or less a sufficient low spot light source with high brightness can be formed, and at the same time the light is collected by the concave reflector 11 to attain a desirable light receiving angle, resulting in that it is possible to attain a preferable characteristic as a light source device for a projector and a light source device for an optical fiber.

Further, the light emitting bulb 21 has a form that is extended to an elongated shape in a direction of the optical axis L, whereby the length of the anode 24 can be increased and a substantial thermal dispersion effect can be realized, and further the outer diameter of the anode 24 can be reduced, resulting in that the amount of light shielded by the anode 24 is reduced and so, in view of this fact, the rate of utilization of light can be increased.

Figure 4:
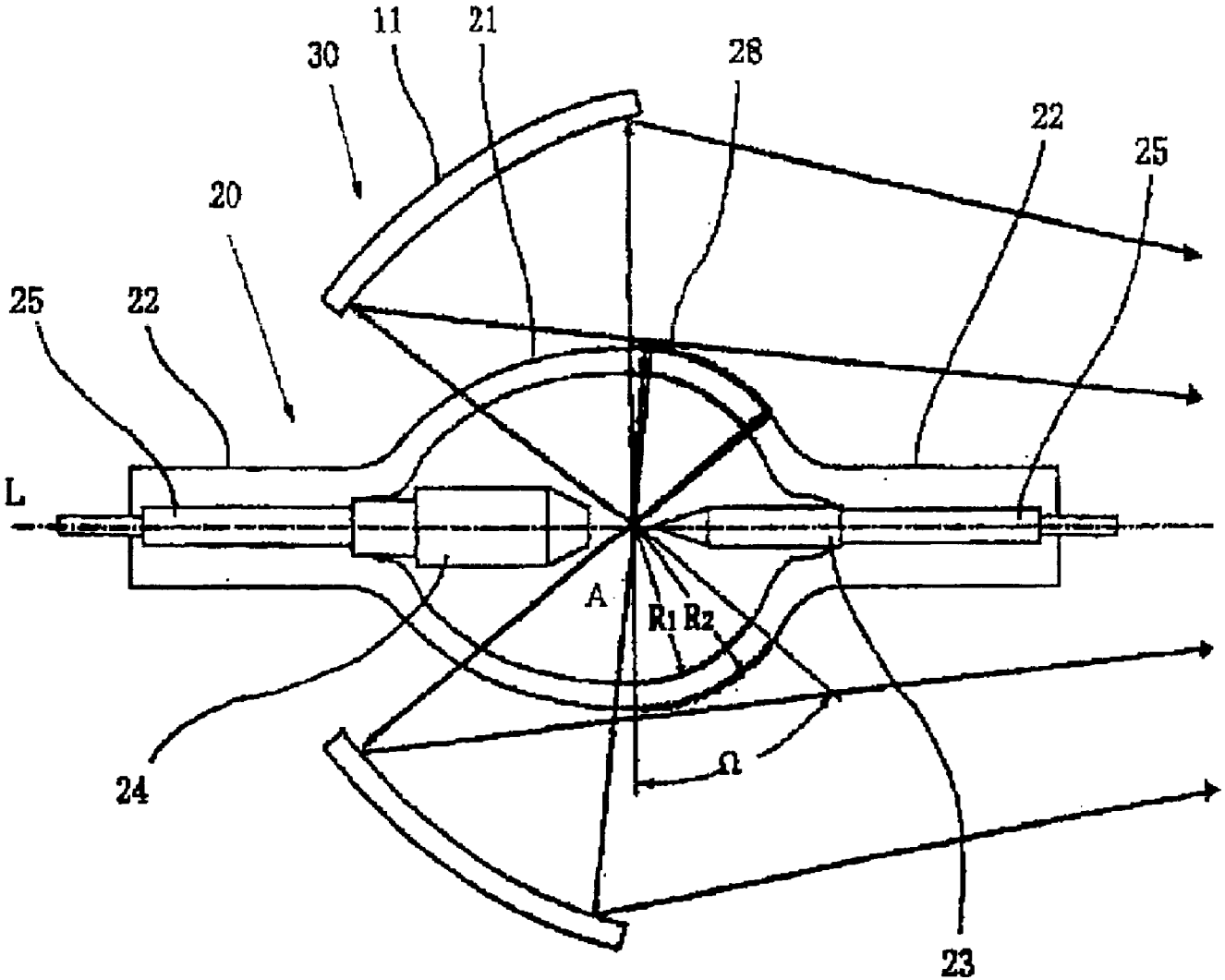
FIG. 4 is an illustrative view showing a constitution of another example of the light source device of the present invention.

FIG. 4 is an illustrative view showing a configuration of another example of the light source device of the present invention. In the case of this light source device 30, the outer surface within the specific portion of the light emitting bulb 21 of the short arc discharge lamp 20 is provided with a reflective film 28.

As a practical example of this reflective film 28, it is possible to apply a dielectric multi-layer film in which tantalum oxide ($Ta_2O_5$) and silica ($SiO_2$) are laminated, for example, a thin film of silver or aluminum or the like.

In accordance with such a configuration as above, both inner surface reflected light and outer surface reflected light radiated to the front region of the light emitting bulb 21, as described above, are returned back to the arc region and can be collected by the concave reflector 11, the light which might pass through the outer surface of the bulb wall of the light emitting bulb 21 is also reflected by the reflecting film 28 and returned back to the arc region, so that this light can also be collected by the concave reflector 11, the rate of utilization of light can be increased to a quite high degree and the construction of the light source device can be made simple and small in size.

In the case of the light source device of the present invention, it is necessary that the specific portions of the inner surface and the outer surface of the bulb wall of the light emitting bulb have spherical surfaces, the electrodes are arranged at appropriate positions in the light emitting bulb with high accuracy and the center of the spherical surface is coincident with the center A of the arc.

Figure 5:
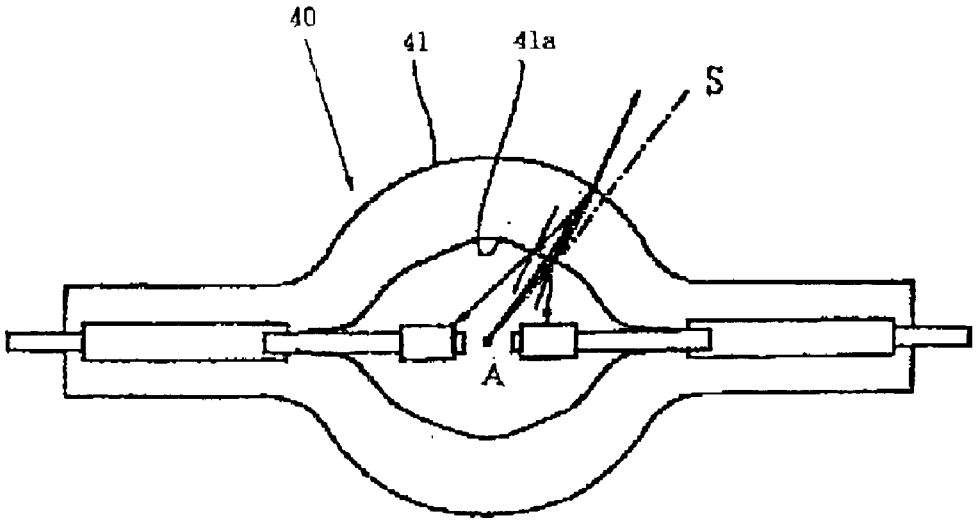
FIG. 5 is an illustrative view illustrating a case in which an inner surface of a bulb wall of the light emitting bulb is not spherical.

By contrast, in the case that the inner surface 41*a* of the bulb wall of the light emitting bulb 41 is a non-spherical surface as shown in FIG. 5, for example, the reflected light reflected by the inner surface 41*a* of the light radiated in a possible direction S in the front region is dispersed so that it is impossible to attain an effective utilization of the reflected light.

Figure 6:
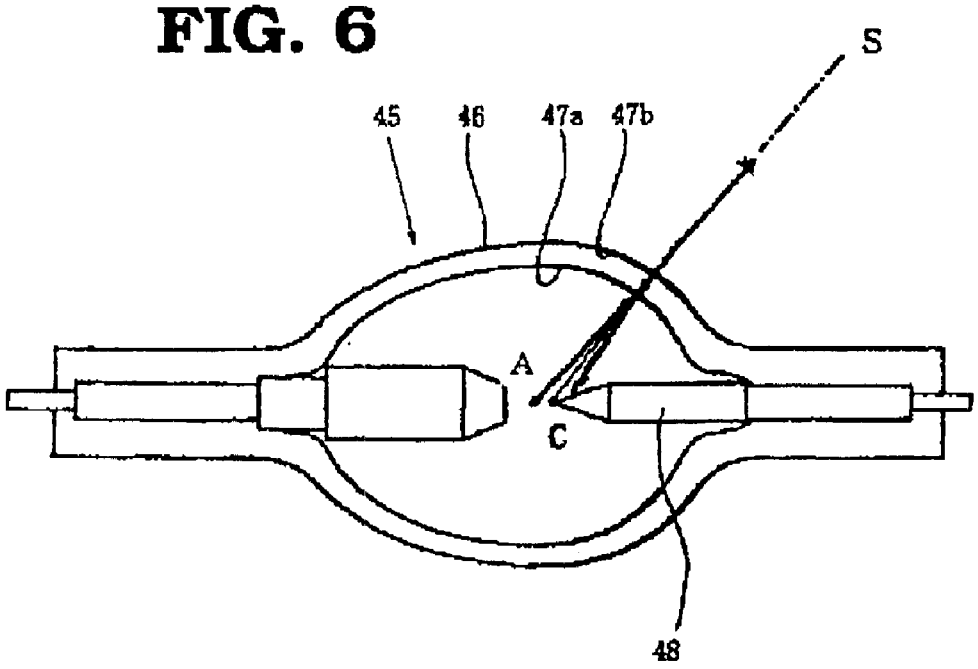
FIG. 6 is an illustrative view showing a case in which an electrode is not properly arranged with respect to the light emitting bulb.
Figure 7:
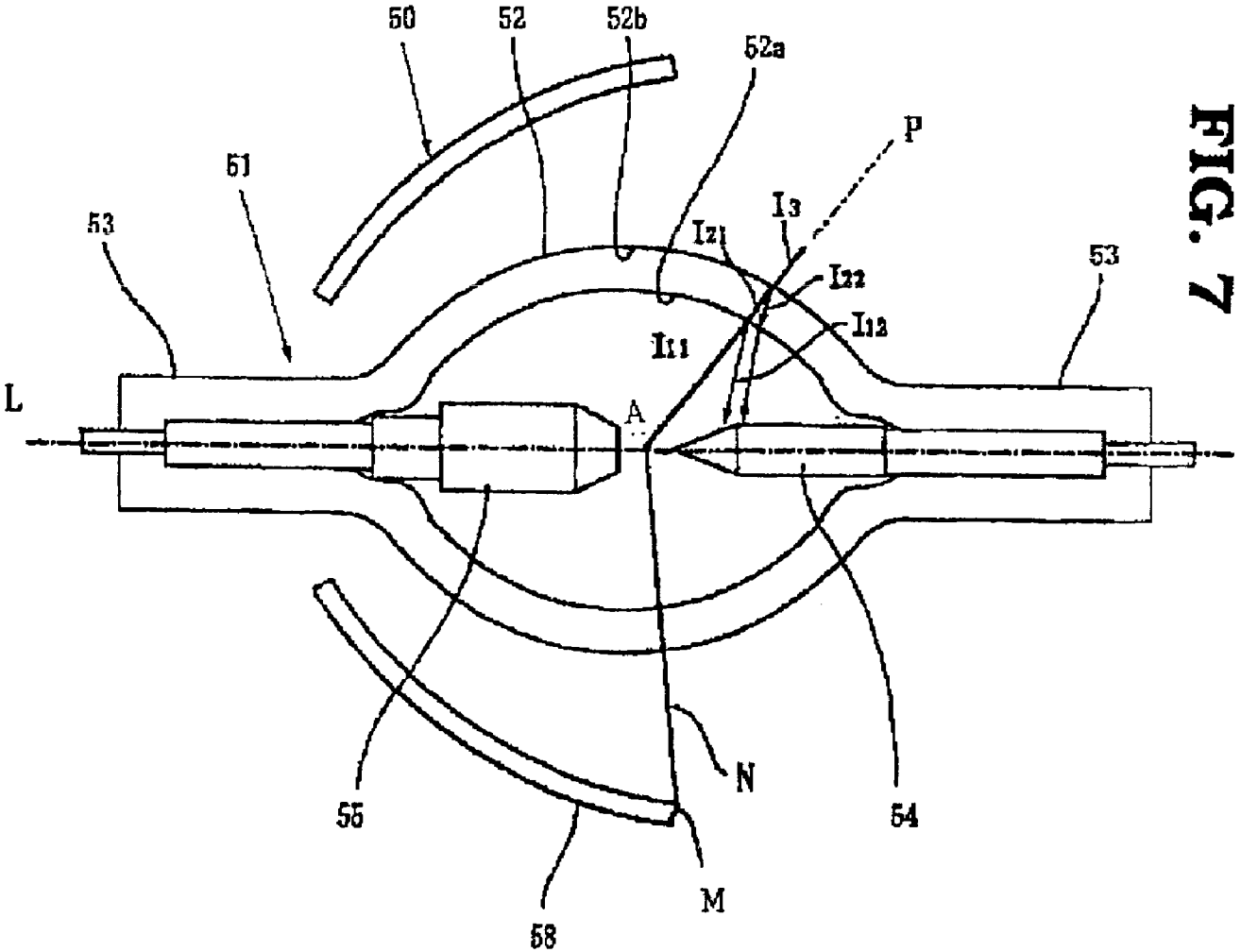
FIG. 7 is an illustrative view showing one example of a constitution of the light source device of the prior art.

In addition, even in the case that a short arc discharge lamp 45 where the inner surface and the outer surface are spherical surfaces in the front region of the light-emitting bulb 46 is applied as shown in FIG. 6, for example, when the center C of the spherical surface is not coincident with the center A of the arc, the reflected light caused by the inner surface 47*a* and the outer surface 47*b* is reflected in a direction widely shifted from the center A of the arc, resulting in that it is impossible to perform an effective utilization thereof due to the fact that the light is shielded by the cathode 48 or part of it is absorbed.

However, in the case of the light source device of the present invention, the inner surface and the outer surface of the region in the specific portion in the front region of the light emitting bulb of the short arc type discharge lamp are spherical surfaces, and the center of the spherical surface is coincident with the center of the arc, resulting in that light radiated to the front region of the light emitting bulb can be utilized effectively and a high rate of utilization of light can be realized.

In this case, it is satisfactory that the center of the aforesaid spherical surfaces is substantially coincident with the center A of the arc, and although they are coincident with each other within a range of 50% of the distance between the electrodes, for example, it is preferable that they are coincident with each other within a range of 30% or less.

In addition, in the present invention, even if each of the inner surface and the outer surface in the area of the specific portion in the front region strictly is an elliptical surface, when its eccentricity is 0.4 or less, it is possible to assume that the elliptical surface is a spherical surface and so the aforesaid effects can be realized.

Although more practical embodiments of the present invention will be described hereinafter, it is of course apparent that the present invention is not limited to these embodiments.

<Embodiment 1>

The light source device (10) of the present invention has been manufactured with reference to the configuration shown in FIG. 1. The short arc type discharge lamp (20) of the light source device (10) is a super high pressure mercury lamp with a rated consumption power being 180 W, the distance between the electrodes being 2.5 mm and the pressure during operation being 12 MPa. The light emitting bulb (21) is made such that a solid angle 4 sr (which corresponds to a plane angle Ω of 47° in a longitudinal section) with the center (A) of the arc in the front region being the apex and the optical axis (L) of the concave reflector (11) being a central axis is the specific portion, and in this region the outer surface is a spherical surface with the radius (R1) being 6 mm and the inner surface is a spherical surface with the radius (R2) being 3.8 mm. In the rearward region, it is of a spinning barrel type having a maximum outer diameter of 12 mm and the length of 6.5 mm.

The cathode (23) is arranged at a position spaced apart by 0.8 mm from the center (A) of the arc in a forward direction of the optical axis (L) of the concave reflector (11).

The concave reflector (11) is an elliptical surface mirror with the opening diameter being 40 mm, a first focal distance being 10 mm and a second focal distance being 80 mm. The light receiving solid angle is 4 sr with the center (A) of the arc of the discharge lamp (11) being applied as an apex and the optical axis (L) of the concave reflector (11) being applied as a central axis.

When the aforesaid light source device was operated, a radiance spot was formed in a circular region with a diameter of about 20 mm in an irradiated area located in the second focal point of the concave reflector (11). The optical flux at this radiance spot was larger by about 6% as compared with that of the same rated short arc discharge lamp having an elliptical light emitting bulb. In addition, the optical flux in the circular region with a diameter of about 6 mm was larger by about 5%.

<Embodiment 2 >

The light source device of the present invention was manufactured with reference to the configuration shown in FIG. 4 in the same manner as that of the embodiment 1, except for the condition being applied that the short arc discharge lamp has a reflective film 28 formed on the outer surface in the specific portion of the light emitting bulb 21.

The reflective film (28) is made by laminating 27 layers of tantalum oxide ($Ta_2O_5$) and silica ($SiO_2$) and its thickness is about 2 $\mu$m.

The range where the reflective film (28) is formed is a range with a solid angle of 5 sr with the center (A) of the arc being applied as an apex and the optical axis (L) of the concave reflector (11) being applied as a central axis.

The aforesaid light source device was operated and it was found that the radiance spot was formed in a circular region with a diameter of 20 mm in the irradiated area located in the second focal point of the concave reflector (11). The illuminance in this radiance spot was further larger by about 40% than that of the embodiment 1.

In accordance with the light source device of the present invention, it is possible to advantageously utilize the part of light radiated to the front region, resulting in that it is possible to realize a high rate of utilization of light.

That is, the inner surface and the outer surface at least in the part of the specific portion in the front region of the light emitting bulb of the short arc discharge lamp are spherical surfaces, wherein the center of each of the spherical surfaces coincides with the center of the arc, whereby the light reflected by these surfaces is returned back to the arc region, resulting in that the reflected light can be utilized effectively by the concave reflector and thus the rate of utilization of light can be increased.

In the case that the reflective film is provided on the outer surface at least in the specific, portion in the front region of the light emitting bulb of the short arc type discharge lamp, light which might pass through the outer surface of the bulb wall of the light emitting bulb is also reflected and returned back to the arc region, resulting in that almost all of the light radiated into the front region can be utilized effectively by the concave reflector and the construction of the light source device can be made simple and its size can be made small.

What is claimed is:

1. A light source device comprising:

a short arc discharge lamp having a pair of opposed electrodes within a light emitting bulb of a discharge container, said electrodes being spaced from each other at a distance of 4.0 mm or less;

a concave reflector having an optical axis arranged to coincide with a direction of an arc produced by the electrodes when the discharge lamp is activated, said light emitting bulb having an inner surface and an outer surface which, at least in a specific portion, have substantially spherical surfaces with a center of curvature which is at a center of the arc;

wherein said specific portion is located in front of a critical line that passes through said light emitting bulb, said specific portion being an angle having an apex at the center of the arc, and said concave reflector having an optical axis that is at least 3 sr in front of a plane which passes through the center of the arc and perpendicular to the optical axis of the concave reflector.

2. A light source device according to claim 1, further comprising a reflective film provided at least in said specific portion on the outer surface of said light emitting bulb.

3. A light source device according to claim 2, wherein said electrodes comprise an anode, and a cathode positioned in the concave reflector in front of said anode.

4. A light source device according to claim 3, wherein said light emitting bulb has a form that is elongated in a direction along the optical axis in a rearward region located behind said critical straight line.

5. A light source device according to claim 1, wherein said electrodes comprise an anode, and a cathode positioned in the concave reflector in front of said anode.

6. A light source device according to claim 2, wherein said light emitting bulb has a form that is elongated in a direction along the optical axis in a rearward region located behind said critical straight line.

* * * * *